United States Patent [19]

Soldano

[11] 3,967,512

[45] July 6, 1976

[54] CORK REMOVER

[75] Inventor: Michael J. Soldano, Monsey, N.Y.

[73] Assignee: Lawrence Peska Associates, Inc., New York, N.Y. ; a part interest

[22] Filed: May 19, 1975

[21] Appl. No.: 579,038

[52] U.S. Cl. ..... 81/3.34

[51] Int. Cl.[2] ..... B67B 7/10

[58] Field of Search ..... 81/3.34, 3.48, 3.49

[56] References Cited

FOREIGN PATENTS OR APPLICATIONS

| | | | |
|---|---|---|---|
| 668,912 | 7/1929 | France | 81/3.34 |
| 499,727 | 11/1900 | France | 81/3.49 |
| 929,819 | 7/1947 | France | 81/3.49 |

*Primary Examiner*—Al Lawrence Smith
*Assistant Examiner*—Roscoe V. Parker

[57] ABSTRACT

An apparatus for removing corks accidently forced into wine bottles is disclosed comprising an elongated probe having an end that projects outwardly from the probe and which is adapted to fit under corks so that they may be removed without any substantial fragmentation. A handle is provided on the probe which allows it to be manipulated with one hand.

2 Claims, 3 Drawing Figures

CORK REMOVER

SUMMARY OF THE INVENTION

The present invention relates to apparatus for removing objects from necked containers such as, for example, wine bottles having a stopper such as a cork pushed through the neck of the bottle into the chamber thereof. The apparatus comprises an elongated probe of sufficient length to extend through the neck of such a container into the chamber thereof, wherein the probe has a flat surface on the end for fitting under an object in the chamber of the bottle and for retaining such object when the object is raised through the neck of the container which is narrower is diameter than such object.

DETAILED DESCRIPTION

In using necked containers that are sealed with stoppers that can be forced through the neck portion of the container into the chamber thereof such as corked wine bottles, difficulties are encountered in some instances in either opening the container or re-sealing it after it has been opened in that the stopper in some instances is inadvertently forced down into the chamber of the bottle before it is emptied and interferes with pouring the contents of the container. The stopper, once forced into the chamber, moves toward the opening with the contents when the contents are poured and either plugs the container or slows the flow of the contents from the container to such a degree that it cannot be emptied in any reasonable length of time. In attempting to remove the stopper that has been forced into the chamber of a necked container, many times it is fragmented, and these fragments are inadvertently co-mingled with the contents as a contaminant. Furthermore, many of the devices that may be improvised to remove such stoppers are not only difficult to control in the container but also are inadequate to bring the stopper through the neck of the container which is of a narrower diameter than the stopper.

It is therefore an object of the present invention to overcome these and other difficulties encountered in the prior art.

It is a further object of the present invention to provide apparatus to remove stoppers from the chamber of necked containers.

It is also an object of the present invention to provide apparatus to remove corks that have been forced into the chambers of wine bottles and especially apparatus that can remove such corks without fragmenting it.

These and other objects have been achieved by the present invention which will become apparent from the specification and claims that follow as well as the appended drawing.

Figure 1:
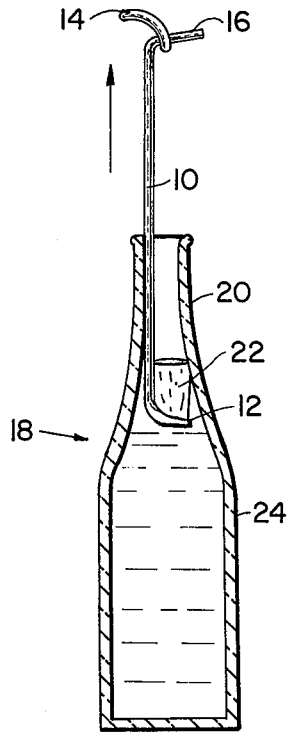
FIG. 1 is a side elevation in section illustrating the use of the apparatus of the present invention to remove a stopper from the chamber of a necked bottle.
Figure 3:
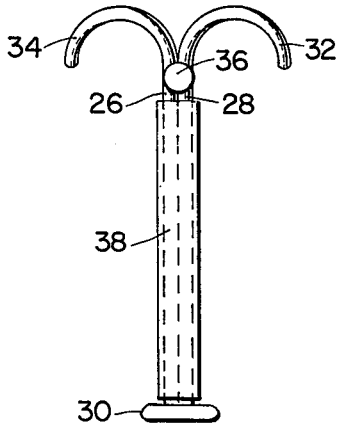
FIG. 3 is an alternate embodiment of the apparatus of the present invention.
Figure 2:
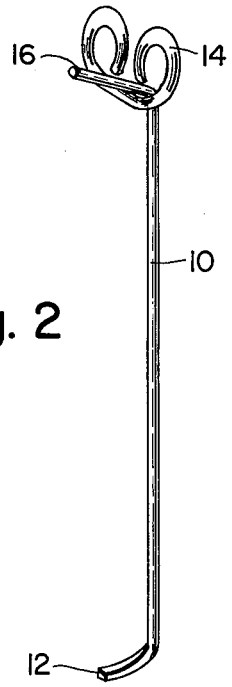
FIG. 2 is a perspective view of one embodiment of the present invention.

FIGS. 1–3 illustrate various embodiments and uses of the invention wherein an elongated probe is provided for insertion into a necked container 18 shown in FIG. 1 having a neck 20 and a chamber 24 positioned below the neck, the probe having shaft 10 as a part thereof, in which shaft 10 is of sufficient length for insertion into the chamber 24 of the necked container, the shaft terminating in an end comprising a flat surface 12 projecting from said shaft for a distance equal to about the diameter of the neck of the container, and pointing in a direction toward the top of the shaft, flat surface 12 being adapted to fit under an object in the container 18 such as stopper 22 which comprises a cork, surface 12 being able to retain stopper 22 when it is raised through neck 20 even though the diameter of stopper 22 is greater than the inside diameter of neck 20. Handle means 14 are mounted on top of shaft 10 for gripably receiving fingers and comprises loops 14 secured to and extending from the top of shaft 10, said loops in other embodiments being partial loops and in any event of sufficient length and contour so as to gripably receive a finger or fingers whether one or a plurality of loops are employed. A thumb rest 16 is provided which extends in the same direction as surface 12 and is arranged at an angle to shaft 10 sufficient to allow upward pressure applied by fingers in loop 14 and downward pressure applied by a thumb on thumb rest 16 for one handed control of shaft 10 and surface 12 under stopper 22 in chamber 24 of bottle 18.

In another embodiment illustrated in FIG. 3 shaft 10 is replaced by parallel shafts 26 and 28 which are joined together and covered by sheath 38 which is fabricated of a resilient material such as rubber or a thermoplastic such as polyvinyl chloride so that when the shafts 26 and 28 are inserted in a brittle container such as a glass bottle the shafts will not be likely to crack or chip the bottle. Shafts 26 and 28 terminate at the top in a handle comprising arcuate extensions 32 and 34 of shafts 28 and 26 respectively, each handle pointing away from one another and convexly downward toward the end 30 of the shafts 26 and 28. Flat surface 30 functions in the same manner as and corresponds to its counterpart 12 illustrated in FIG. 2. Similarly, handles 32 and 34 correspond to and function in the same manner as handle 14 as does thumb rest 36 in comparison to thumb rest 16.

In operation shaft 10 is inserted into a necked container 18 to retrieve a stopper 22 that has been forced into chamber 24. The flat surface 12 is worked under stopper 22 while the apparatus is held in one hand by inserting two fingers in loops 14 and pulling upward with said fingers while placing the thumb from the same hand on thumb rest 16 and pressing downward on such thumb. Once the stopper 22 is positioned on top of surface 12 the apparatus is raised and the stopper 22 pulled through neck 20 and out of bottle 18.

Although the invention has been described by reference to some embodiments it is not intended that it be limited thereby and that certain modifications thereof are to be included as falling within the broad scope and spirit of the foregoing disclosure, the following claims and the appended drawing.

What is claimed is:

1. Apparatus for removing stoppers pushed down through the neck and into the chamber of a container which comprises elongated probe means of sufficient length for insertion into a necked container to reach through the neck of and into the chamber of such container, said probe comprising shaft means terminating in end means, said end means comprising a flat surface projecting from said probe at an angle substantially normal to said probe, said surface pointing in a direction substantially toward the top of said probe, handle means mounted on the top of said probe for gripably receiving fingers comprising two loop means extending from the top of said probe and thumb rest means extending in the same direction as said flat surface and at an angle to said shaft sufficient to allow upward pressure applied by fingers in said loop means and downward pressure applied by a thumb on said thumb rest for one handed control of said shaft and said flat surface under a stopper in the chamber of a necked container.

2. The apparatus of claim 1 where said probe comprises two shafts secured to each other and having a resilient sheath means over said shafts, said sheath being of sufficient length and softness to prevent said probe from chipping a glass container in which said probe is used, the top of said probe terminating in said handle means comprising two arcuate extensions of each handle pointing away from one another and convexly downward toward the end of said probe.

* * * * *